US006820380B2

(12) United States Patent
Tsai

(10) Patent No.: US 6,820,380 B2
(45) Date of Patent: Nov. 23, 2004

(54) STRUCTURE OF AN ANTI-SHOCK DEVICE

(76) Inventor: Chong-Shien Tsai, 3F1., No.9, Alley 10, Lane 86, Sec.2, Nan Kang Rd., Taipei (TW)

( * ) Notice: Subject to any disclaimer, the term of this patent is extended or adjusted under 35 U.S.C. 154(b) by 0 days.

(21) Appl. No.: 10/658,282

(22) Filed: Sep. 10, 2003

(65) Prior Publication Data

US 2004/0074162 A1 Apr. 22, 2004

Related U.S. Application Data

(62) Division of application No. 10/091,540, filed on Mar. 7, 2002, now Pat. No. 6,688,051.

(51) Int. Cl.[7] ..... E04H 9/02

(52) U.S. Cl. ..... 52/167.4; 52/167.7; 52/167.9; 248/636

(58) Field of Search ..... 52/167.1, 167.4, 52/167.7, 167.8, 167.9; 248/678, 346.01, 346.03, 299.1, 288.31, 568, 580, 636

(56) References Cited

U.S. PATENT DOCUMENTS

| | | | | | |
|---|---|---|---|---|---|
| 2,014,643 | A | * | 9/1935 | Bakker | 384/49 |
| 2,359,036 | A | * | 9/1944 | Harper | 296/35.1 |
| 3,978,574 | A | * | 9/1976 | Stith, Jr. | 52/45.21 |
| 4,644,714 | A | * | 2/1987 | Zayas | 52/167.4 |
| 5,071,261 | A | * | 12/1991 | Stuve | 384/36 |
| 5,867,951 | A | * | 2/1999 | Yaguchi et al. | 52/167.4 |
| 6,126,136 | A | * | 10/2000 | Yen et al. | 248/560 |
| 6,631,593 | B2 | * | 10/2003 | Kim | 52/167.9 |
| 6,725,612 | B2 | * | 4/2004 | Kim | 52/167.5 |

FOREIGN PATENT DOCUMENTS

| | | | | | |
|---|---|---|---|---|---|
| DE | 3520364 | A1 | * | 12/1986 | E04B/1/36 |
| JP | 1014338 | A | * | 1/1986 | 52/167.7 |
| JP | 403013637 | A | * | 1/1991 | 52/167.7 |
| SU | 001196439 | A | * | 12/1985 | 52/167.7 |

* cited by examiner

*Primary Examiner*—Brian E. Glessner
(74) *Attorney, Agent, or Firm*—Rosenberg, Klein & Lee

(57) ABSTRACT

An improvement in the structure of an anti-shock device utilized for buildings, important structures and bridge structures that are made of a base, a carrier, a slide block, and a plurality of springs. A slip concavity of a sunken round curved recess is respectively formed in the base top surface and in the carrier bottom surface, and an upper slide block member and a lower slide block member are situated between the two slip concavities. One contact surface between the two slide block members and slip concavities is of a curved contour and the other surfaces are indented seating recesses. A spheroid coupling bearing is nested between the two seating recesses and the upper and lower slide block members are held together by the springs. As so assembled, the anti-shock device base is fastened under the columns of a building structure such that the building achieves the objectives of exceptional shock eliminating capability and greater building structure safety.

12 Claims, 8 Drawing Sheets

STRUCTURE OF AN ANTI-SHOCK DEVICE

This application is a Divisional application of Ser. No. 10/091,540 filed on Mar. 7, 2002, now U.S. Pat. No. 6,688,051 B2.

BACKGROUND OF THE INVENTION

1. Field of the Invention

The invention herein relates to vibration eliminators, and in particular to an improved structure of an anti-shock device utilized in buildings, residences, important structures, and bridges. The invention herein features a unique anti-shock device structure having a double action sliding and swiveling mechanism that increases shock elimination capacity to effectively and economically ensure building structure safety.

2. Description of the Prior Art

Based on mechanical characteristics, conventional anti-shock devices are typically of two categories: spring-type and sliding-type. Manufacturers have recently developed a friction single-sway anti-shock device, a type of anti-shock device that combines the characteristics of both the spring-type and the sliding-type anti-shock devices. The earliest research in this field was a report presented in 1987 by V. Zagas, S. S. Low, and S. A. Mahin of the Earthquake Engineering Research Center, University of California at Berkeley. Since the inventor of the invention herein has conducted detailed research on such anti-shock devices and published the results (C. S. Tsai, 1995; C. S. Tsai, 1997; and C. S. Tsai and L. J. Huang, 1998), the inventor is familiar with such anti-shock devices now available in the industry, the drawbacks of which include the following:

1. The structural design of current friction single-sway anti-shock devices is inappropriate because its components are assembled by vertical stacking such that conjointness of independent components is not possible and, as such, when lifting (a phenomenon that readily occurs at the side columns of multi-story buildings) occurs during an earthquake, the components of the assembled anti-shock device separate, causing a loss of mechanical capability and resulting in the destruction of the building.

2. When conventional friction single-sway anti-shock devices are utilized in fault zones, since movement is of high magnitude, utilization is problematic, and integrity may even be lost, endangering the safety of the building.

3. Since conventional friction single-sway anti-shock devices are highly expensive to fabricate, they are not economical.

In view of the shortcomings of the said conventional shock eliminator, a number of improvements were applied to the present during a prolonged period of extensive research and testing which culminated in the successful development of the invention herein.

To enable the examination committee a further understanding of the structural features of the present invention, the brief description of the drawings below are followed by the detailed description of the invention herein.

SUMMARY OF THE INVENTION

This invention is related to shock eliminators, and in particular to an improved structure of an anti-shock device utilized in buildings, residences, important structures and bridges.

It is the primary object of the present invention to provide an improvement in the structure of an anti-shock device utilized in buildings, residences, important structures and bridges which have a double action sliding and swiveling mechanism that increases shock elimination capacity to effectively and economically ensure building structure safety.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
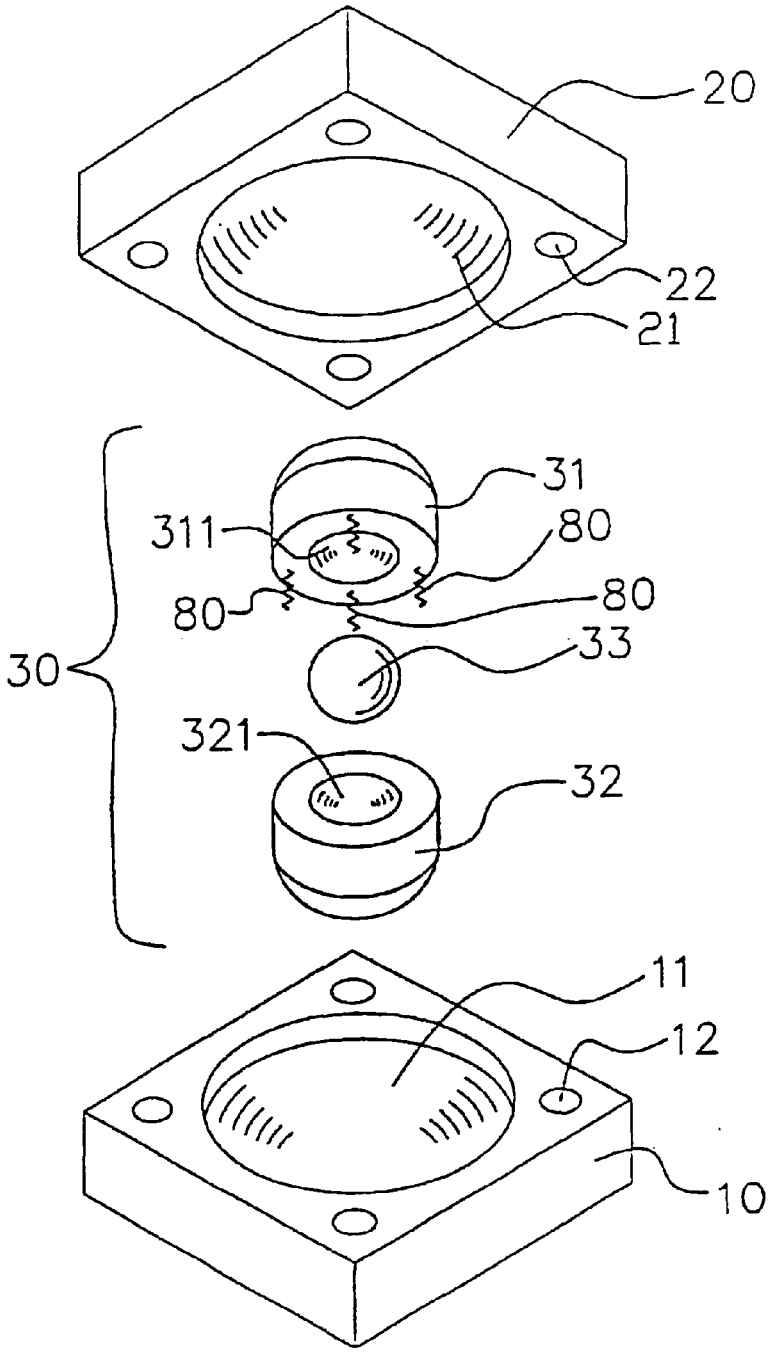
FIG. 1 is an exploded drawing of the invention herein.
Figure 2:
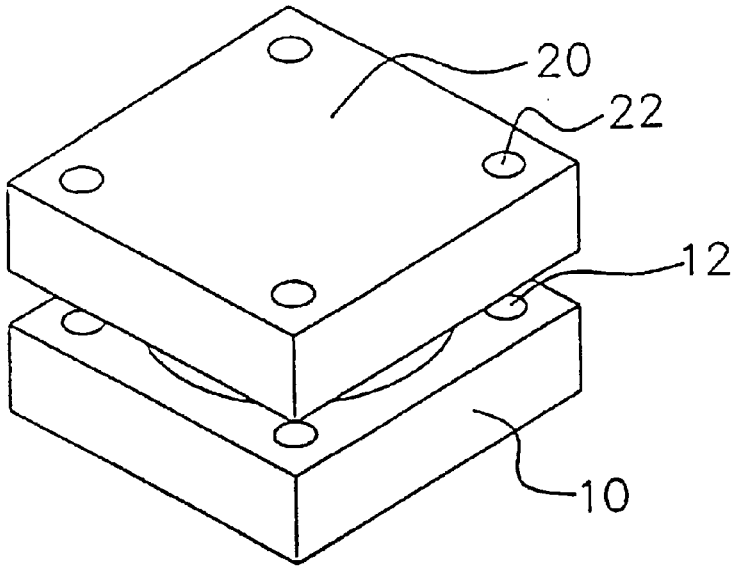
FIG. 2 is a perspective view of the invention in assembled state herein.
Figure 3:
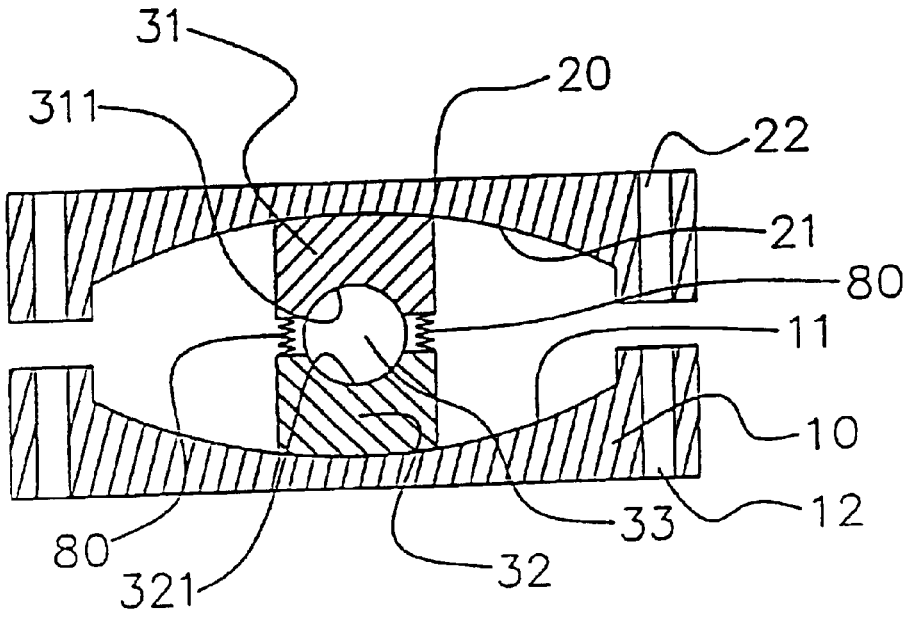
FIG. 3 is a cross-sectional drawing of the invention herein.

Referring to FIG. 1, FIG. 2, and FIG. 3, the invention herein is comprised of a base 10, a carrier 20, a slide block 30, and a plurality of springs 80; the base 10 and the carrier 20 can be square, rectangular, rhombic, circular, oval, or polygonal in shape; a slip concavity 11 and 21 of a sunken round curved recess is respectively formed in the center of the base 10 top surface and in the center of the carrier 20 bottom surface, and the slide block 30 is situated between the two slip concavities 11 and 21; the said slide block 30 consists of an upper slide block member 31, a lower slide block member 32, and a spheroid coupling bearing 33, with the rounded top surface of the upper slide block member 31 and the rounded bottom surface of the lower slide block member 32 respectively placed into the slip concavities 21 and 11 such that they are firmly postured against the slip concavities 21 and 11 but capable of sliding; a hemispherical seating recess 311 and 321 is respectively formed in the bottom surface of the upper slide block member 31 and in the top surface of the lower slide block member 32, and the spherical coupling bearing 33 is nested between the two seating recesses 311 and 321; as so assembled, the anti-shock device base 10 is bolt- or pin-fastened onto the building foundation and the carrier 20 is fastened to the bottom of the building columns; the contoured design of the base 10 and carrier 20 slip concavities 11 and 21 provides for an accumulated potential energy during the slide block 30 movement process that enables the slide block 30 to efficiently return to the original position after excursion and, furthermore, the design of the slide block 30 is such that the hemispherical seating recesses 311 and 321 of the upper and lower slide block members 31 and 32 are mated around the coupling bearing 33, and the upper and lower slide block members 31 and 32 are held together by the springs 80 to increase energy dissipation capacity. The springs 80 can be a damping device to enhance energy dissipation capacity.

Figure 4:
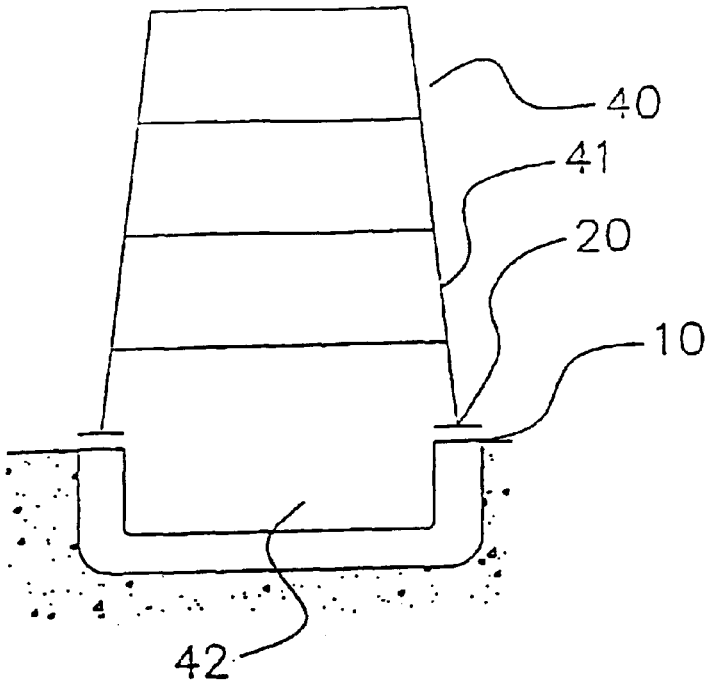
FIG. 4 is a cross-sectional drawing of the invention herein installed in a building structure.
Figure 5:
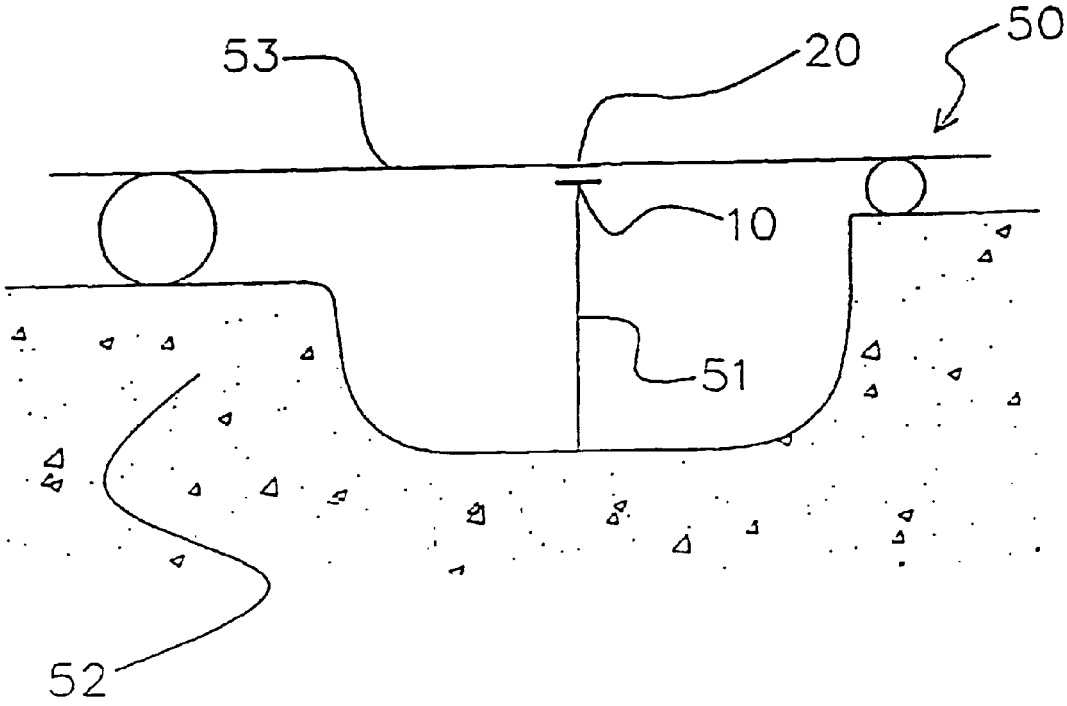
FIG. 5 is a cross-sectional drawing of the invention herein installed in a bridge structure.
Figure 6:
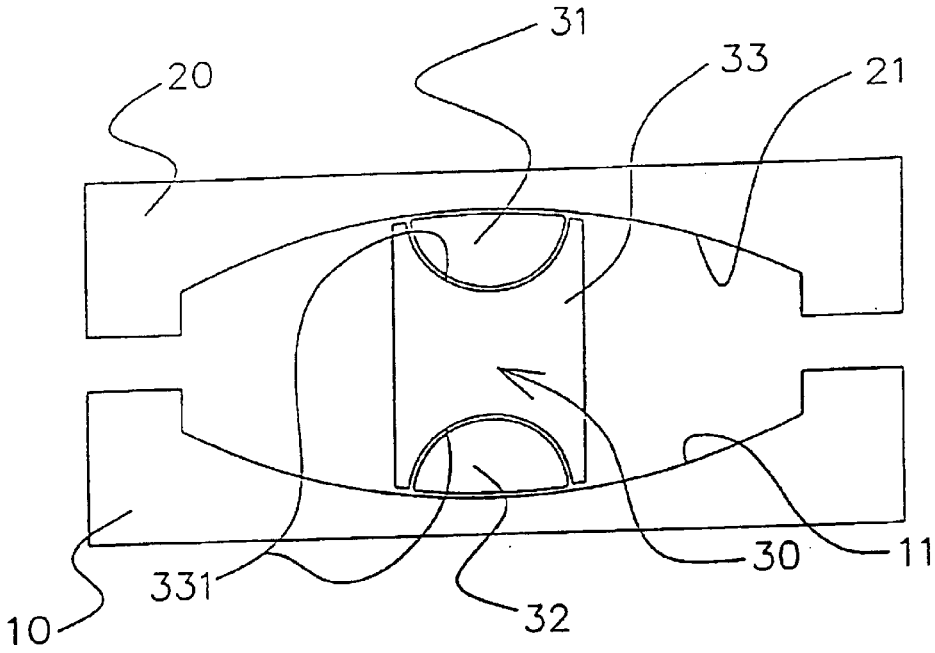
FIG. 6 is a cross-sectional drawing of a second structural variation of the invention herein.
Figure 7:
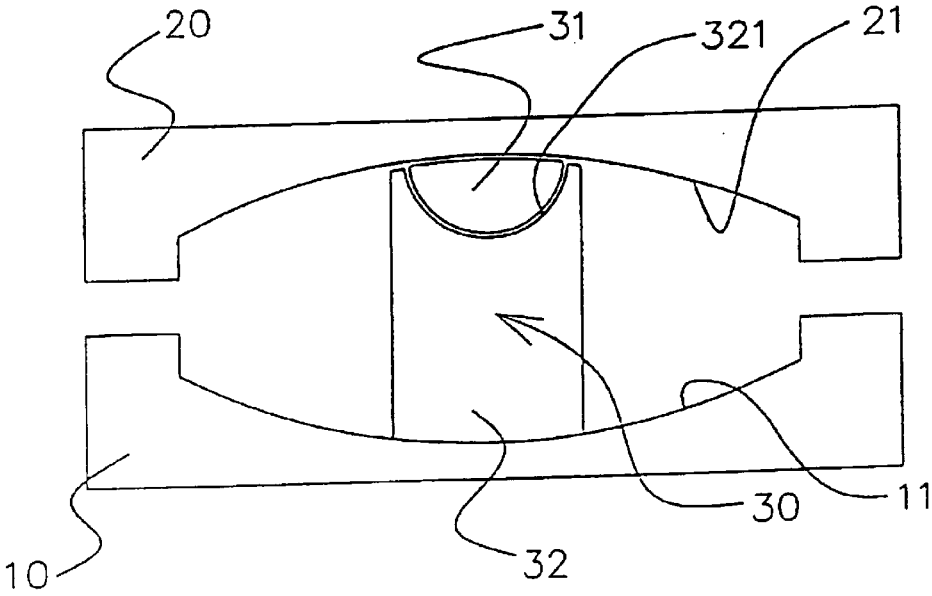
FIG. 7 is a cross-sectional drawing of a third structural variation of the invention herein.
Figure 8:
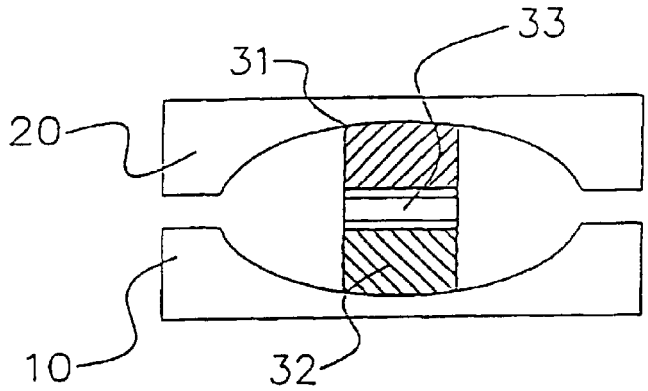
FIG. 8 is a cross-sectional drawing of a fourth structural variation of the invention herein.
Figure 9:
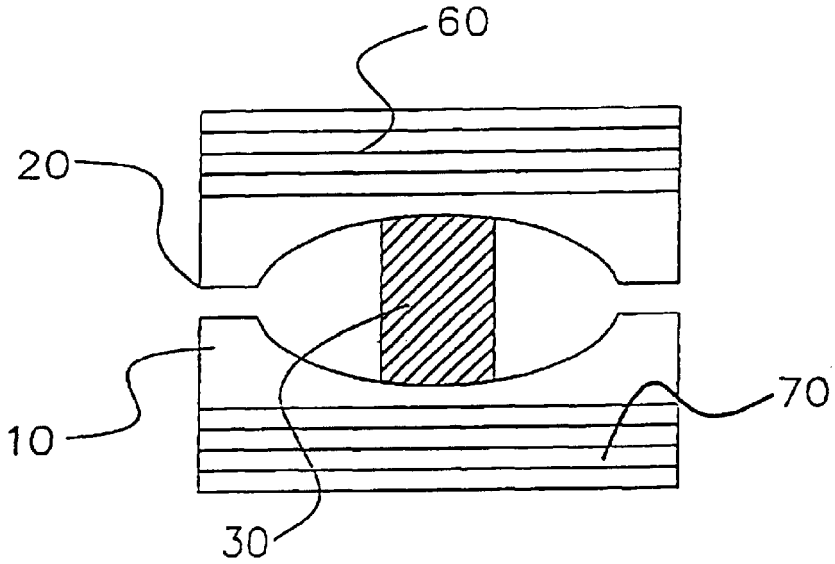
FIG. 9 is a cross-sectional drawing of a fifth structural variation of the invention herein.
Figure 10:
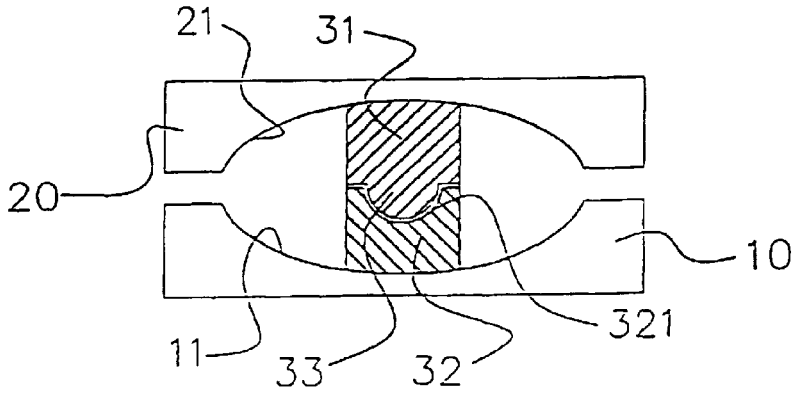
FIG. 10 is a cross-sectional drawing of a sixth structural variation of the invention herein.
Figure 11:
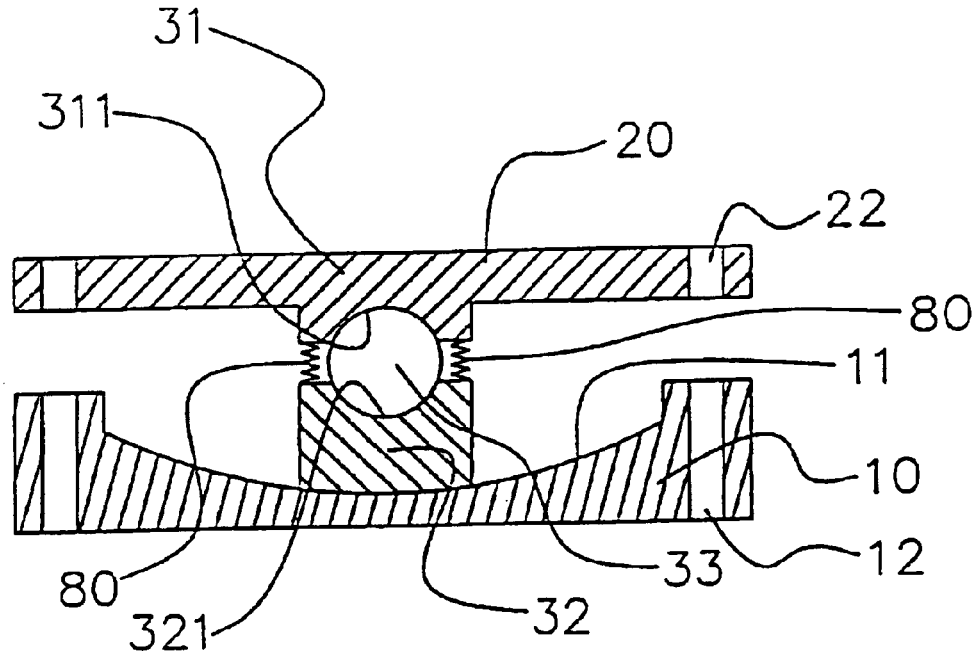
FIG. 11 is a cross-sectional drawing of a seventh structural variation of the invention herein.
Figure 12:
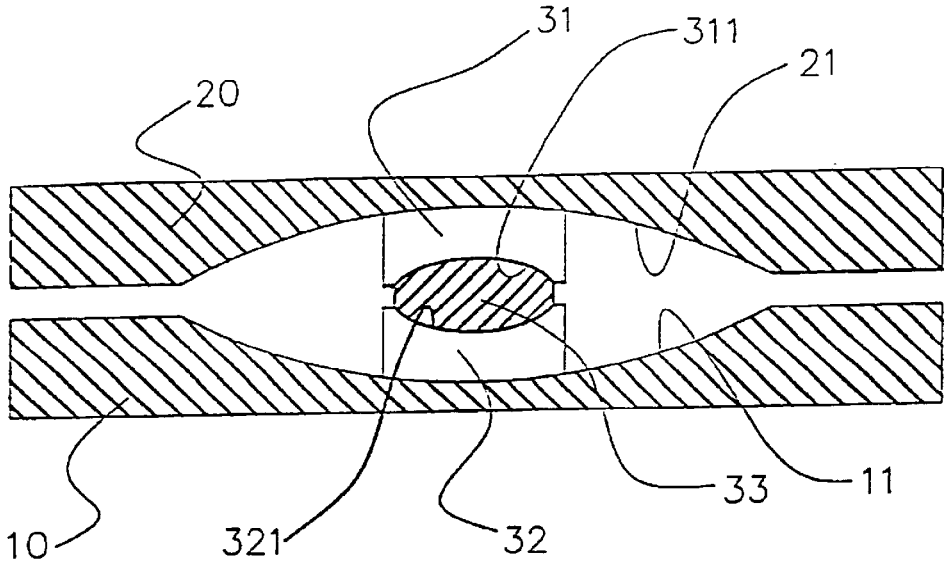
FIG. 12 is a cross-sectional drawing of an eighth structural variation of the invention herein.
Figure 13:
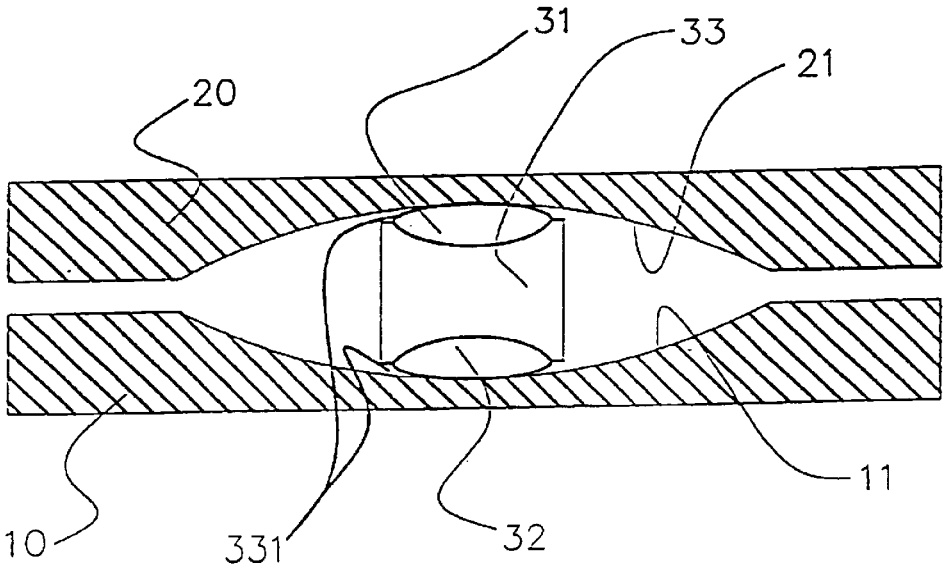
FIG. 13 is a cross-sectional drawing of a ninth structural variation of the invention herein.
Figure 14:
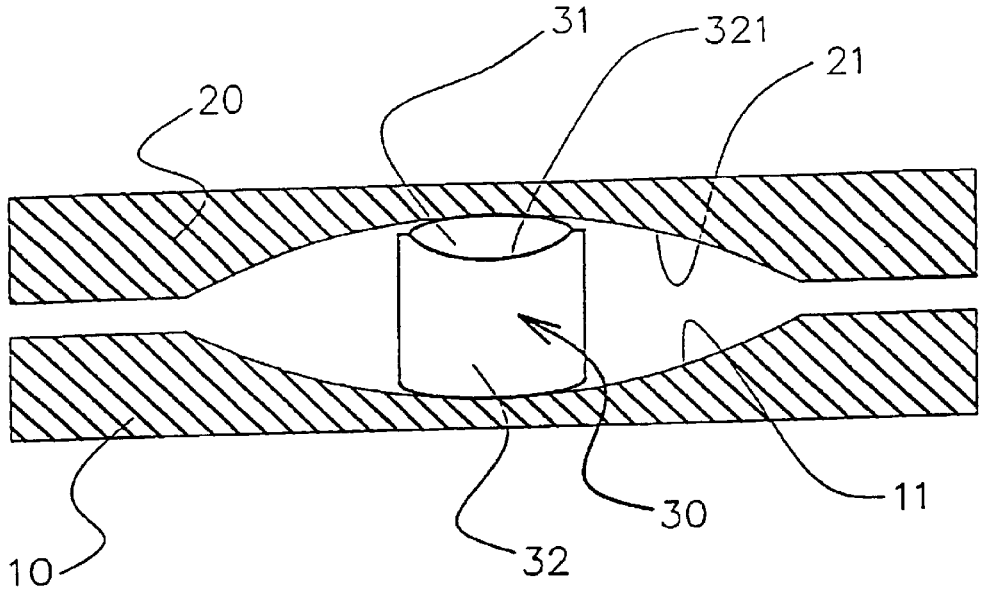
FIG. 14 is a cross-sectional drawing of a tenth structural variation of the invention herein.
Figure 15:
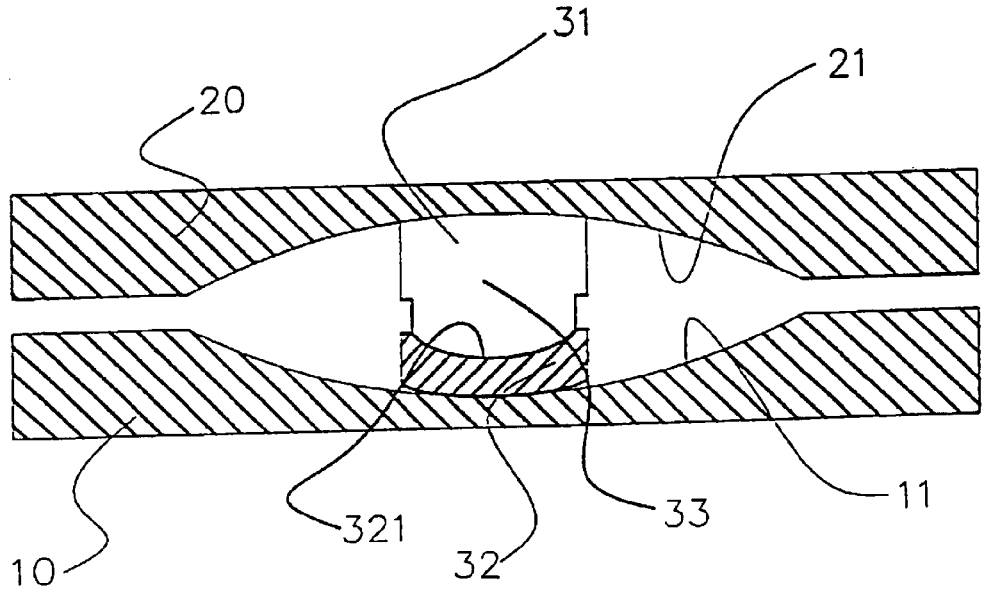
FIG. 15 is a cross-sectional drawing of an eleventh structural variation of the invention herein.

FIG. 4 and FIG. 5 illustrate the invention herein when utilized in a building and a bridge structure; as indicated in FIG. 4, the carrier 20 of the anti-shock device is fastened to the bottom of the column 41 of a building 40 and the base 10 is fastened onto a basement 42 surface serving as a foundation; as indicated in FIG. 5, the carrier 20 of the anti-shock device is fastened to the bottom surface of the bridge 50 girder 53 and the base 10 is fastened onto the top surface of the foundation 52 pier 51; as such, the said installations achieve shock elimination capability Referring to FIG. 6, FIG. 7, FIG. 8, FIG. 9, FIG. 10, FIG. 11, FIG. 12, FIG. 13, FIG. 14, and FIG. 15, the various structural component variations of the anti-shock device of the invention herein; as indicated in FIG. 6, the base 10 and the carrier 20 are of the same shape, but the upper slide block member 31 and the lower slide block member 32 of the slide block 30 are hemispherical and the coupling bearing 33 is columnar, with a hemispherical seating recess 331 is formed in its top and the bottom that allows the hemispherical upper and lower slide block members 31 and 32 to be respectively placed into the two seating recesses 331 as well as the slip concavity 21 and 11 respectively formed in the center of the carrier 20 bottom surface and in the center of the base 10 top surface such that they are firmly postured against the slip concavities 21 and 11 but capable of sliding; as indicated in FIG. 7, the said slide block 30 only consists of an upper and lower slide block member 31 and 32, the upper slide block member 31 is hemispherical like the upper slide block member 31 in FIG. 6, the lower slide block member 32 is columnar and has a hemispherical seating recess 321 that couples with the upper slide block member 31 and its bottom surface is rounded to match the inwardly contoured surface of the slip concavity 11 but capable of sliding and is firmly postured against the slip concavity 11. As indicated in FIG. 8, the slide block 30 is designed such that a rubber, laminated rubber, lead rubber, high damping, or spring coupling bearing 33 is disposed between the upper and lower slide block members 31 and 32; as indicated in FIG. 9, the slide block 30 is designed as a single column having a rounded top and bottom surface, with a lower and an upper support pad 70 and 60 of a rubber, a laminated rubber bearing, a lead-rubber bearing, a high-damping rubber bearing, or a spring composition respectively attached to the base 10 bottom surface and the carrier 20 top surface; as indicated in FIG. 10, the upper and lower slide block members 31 and 32 are of a convergence design, but the coupling bearing 33 is a hemispherically ended column connected to the bottom portion of the upper slide block member 31 and the coupling bearing 33 of the upper slide block member 31 is nested in a hemispherical seating recess 321 formed in the center of the lower slide block member 32 top surface. As indicated in FIG. 11, the carrier 20 is a flat plate and, furthermore, the upper slide block member 31 and the carrier 20 are integrated into a single body, with the remaining structure consisting of a lower slide block member 32, a coupling bearing 33, a base 10, and a plurality of springs 80, an assembly not unlike that shown in FIG. 1; as indicated in FIG. 12 and similar to FIG. 3, the coupling bearing 33 is an ovoid solid, a lentil-shaped spheroid, or an egg-shaped spheroid, the seating recesses 311 and 321 are of a partially hemispherical contour that accommodates a portion of the ovoid solid, a lentil-shaped spheroid or an egg-shaped spheroid surface; as indicated in FIG. 13 and similar to FIG. 6, the upper and lower slide block members 31 and 32 are partially hemispherical, ovoid, lentil-shaped, or egg-shaped and the seating recesses 331 are partially hemispherical to accommodate a portion of the ovoid solid, a lentil-shaped spheroid or an egg-shaped spheroid surface; as indicated in FIG. 14 and similar to FIG. 7, the upper slide block member 31 is partially hemispherical, ovoid, lentil-shaped or egg-shaped and the seating recess 321 is partially hemispherical to accommodate a portion of the ovoid solid, a lentil-shaped or an egg-shaped spheroid surface; as indicated in FIG. 15 and similar to FIG. 10, the coupling bearing 33 is partially hemispherical, partially ovoid, partially lentil-shaped or partially egg-shaped and the seating recess 321 is partially hemispherical to accommodate a portion of the ovoid solid, a lentil-shaped spheroid or an egg-shaped spheroid surface. All of the said structural variations have similar shock elimination capability. In the said assembly approaches, the physical arrangement of the base 10, the carrier 20, and the slide block 30 is interchangeable and reversible to achieve the same shock eliminating capability. The curvatures and sizes of the slip concavities 11 and 21 can be different. Furthermore, the surfaces of the slip concavities 11 and 21, the surfaces of the upper and lower slide block members 31 and 32, the surface of the coupling bearing 33, and the surfaces of the seating recess 311, 321, and 331 are coated with a wear-resistant, lubricating material to increase shock eliminating performance. The coated materials on the slip concavities 11 and 21 can be different according to the distance from the center of the slip concavities 11 and 21.

Since the said structural design of the anti-shock device herein improves the original capability of such mechanisms and thus provides for greater building structure safety and, furthermore, since its structure is straightforward, production as well as installation is easier and production cost is lower, the invention herein is capable of enhanced performance and, furthermore, is economically advantageous and an invention of improved utility, therefore, the invention herein meets patenting requirements and is lawfully submitted as a new patent application.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of an anti-shock device comprised of a base, a carrier, a slide block; a slip concavity of a sunken round curved recess is respectively formed in the center of the said base top surface and in the center of the said carrier bottom surface, and the said slide block is situated between the two said slip concavities; the said slide block consists of an upper slide block member, a lower slide block member, and a coupling bearing; a seating recess is respectively formed in the bottom surface of the said upper slide block member and in the top surface of the said lower slide block member, and said coupling bearing is nested between the two said seating recesses; the contact surfaces between the said upper and lower slide block members and the said slip concavities consist of round curved surfaces that match the curvature of the said slip cavities, said base of the anti-shock device is fastened onto the building foundation and the said carrier is fastened to the bottom section of the building columns to provide shock eliminating capability.

2. The structure of an anti-shock device as claimed in claim 1, wherein the said coupling bearing is a rubber bearing, a laminated rubber bearing, a lead-rubber bearing, a high-damping rubber bearing disposed between the said upper and lower slide block members and the surfaces of the said upper and lower slide block members that contact the said slip concavities are round curved convexity.

3. The structure of an anti-shock device as claimed in claim 1, wherein the said base, the said carrier, and the said slide block are of a physical arrangement that is interchangeable and reversible.

4. The structure of an anti-shock device as claimed in claim 1, wherein the said upper and lower slide block members are selected from the group consisting of sectionally square, rectangular, rhombic, circular, star, and polygonal shape.

5. The structure of an anti-shock device as claimed in claim 1, wherein the said slip concavity surfaces are coated with a wear-resistant, lubricating material.

6. The structure of an anti-shock device as claimed in claim 1, wherein the said upper and lower slide block member surfaces are coated with a wear-resistant, lubricating material.

7. The structure of an anti-shock device as claimed in claim 1, wherein the said coupling bearing surfaces are coated with a wear-resistant, lubricating material.

8. The structure of an anti-shock device as claimed in claim 1, wherein the said seating recess surfaces are coated with a wear-resistant, lubricating material.

9. The structure of an anti-shock device as claimed in claim 1, wherein the indented area of the said seating recess in the bottom surface of the said upper slide block member and in the top surface of said lower slide block member is are selected from the group consisting of partially hemispherical, a partial ovoid, a partial lentil-shaped and a partial egg-shaped solid and said coupling bearing is selected from the group consisting of an ovoid solid, a lentil-shaped spheroid an egg-shaped spheroid.

10. The structure of an anti-shock device as claimed in claim 1, wherein the said coupling bearing is selected from the group consisting of partially hemispherical, partially ovoid, partially lentil-shaped and partially egg-shaped and the surface of said seating recess is selected from the group consisting of surface of a partial hemisphere, a partial ovoid, a partial lentil-shaped and partial egg-shaped solid.

11. The structure of an anti-shock device as claimed in claim 1, wherein the curvature of said slip concavity is adapted to vary according to the distance from the center of the said slip concavity.

12. The structure of an anti-shock device as claimed in claim 5, wherein the coated materials on the said slip concavity surfaces are adapted to be changed according to the distance from the center of the said slip concavities.

* * * * *

UNITED STATES PATENT AND TRADEMARK OFFICE

CERTIFICATE OF CORRECTION

PATENT NO. : 6,820,380 B2
DATED : November 23, 2004
INVENTOR(S) : Chong-Shien Tsai It is certified that error appears in the above-identified patent and that said Letters Patent is hereby corrected as shown below:

Column 5,
Lines 16-34, should be amended as follows:

1. A structure of anti-shock device comprised of a base, a carrier, and a slide block; a slip concavity of a sunken round curved recess is respectively formed in the center of the said base top surface and in the center of the said carrier bottom surface, and the said slide block is situated between the two said slip concavities; the said slide block consists of an upper slide block member, a lower slide block member, and a coupling bearing; a seating recess is formed in the top surface of the said lower slide block member, and the said coupling bearing is nested between the upper slide block and the lower slide block member; contact surfaces between the said upper and lower slide block members and the said slip concavities consist of round curved surfaces that match the curvature of the said slip concavities; as so assembled, the said base of the anti-shock device is fastened onto the building foundation and the said carrier is fastened to the bottom section of the building columns to provide shock eliminating capability.

Signed and Sealed this

Twenty-seventh Day of September, 2005

JON W. DUDAS
*Director of the United States Patent and Trademark Office*